US010634419B2

(12) United States Patent
Wu

(10) Patent No.: US 10,634,419 B2
(45) Date of Patent: Apr. 28, 2020

(54) THERMOELECTRIC WINE CABINET WITH AN EXTERNAL POWER SUPPLY

(71) Applicant: Zhongshan Candor Electric Appliances Co., Ltd, Zhongshan, Guangdong province (CN)

(72) Inventor: Weiwen Wu, Zhongshan (CN)

(73) Assignee: ZHONGSHAN CANDOR ELECTRIC APPLIANCES CO., LTD, Zhongshan (CN)

( * ) Notice: Subject to any disclaimer, the term of this patent is extended or adjusted under 35 U.S.C. 154(b) by 79 days.

(21) Appl. No.: 15/814,593

(22) Filed: Nov. 16, 2017

(65) Prior Publication Data

US 2018/0320954 A1 Nov. 8, 2018

(30) Foreign Application Priority Data

May 3, 2017 (CN) ..... 2017 2 0486646 U

(51) Int. Cl.
*F25B 21/02* (2006.01)
*F25D 23/02* (2006.01)
(Continued)

(52) U.S. Cl.
CPC ..... *F25D 23/062* (2013.01); *F25B 21/02* (2013.01); *F25D 21/14* (2013.01); *F25D 23/02* (2013.01);
(Continued)

(58) Field of Classification Search
CPC ..... F25B 21/02; F25B 21/04; F25B 2321/02; F25D 11/00; F25D 11/003; F25D 23/06;
(Continued)

(56) References Cited

U.S. PATENT DOCUMENTS 3,099,914 A * 8/1963 De Witt ..... F25D 21/08 62/276
2003/0084670 A1* 5/2003 Kim ..... F25B 21/02 62/3.6

(Continued)

FOREIGN PATENT DOCUMENTS

GB 1040485 A * 8/1966 ..... F25B 21/02

*Primary Examiner* — Frantz F Jules
*Assistant Examiner* — Erik Mendoza-Wilkenfel
(74) *Attorney, Agent, or Firm* — Birch, Stewart, Kolasch & Birch, LLP

(57) ABSTRACT

A thermoelectric wine cabinet with an external power supply is provided. The wine cabinet comprises a case, a door, a circuit board, a refrigeration system, a power cord, an external power supply and a water-receiving member that opens upwards. The case comprises a housing, a liner and a heat insulating layer provided between the housing and the liner. A rear end of the case is provided with a chamber that opens rearwards for containing the water-receiving member. A heat dissipation chamber is provided above the chamber for containing the water-receiving member. The refrigeration system is provided inside the heat dissipation chamber. The circuit board is provided on a rear plate of the housing inside the heat dissipation chamber. The power cord passes through a wall of the heat dissipation chamber, extends thereinto and is connected to the circuit board. The water-receiving member communicates with the liner through a water-receiving groove passing through the heat insulating layer.

10 Claims, 5 Drawing Sheets

(51) Int. Cl.

| | |
|---|---|
| ***F25D 21/14*** | (2006.01) |
| ***F25D 11/00*** | (2006.01) |
| ***F25D 23/06*** | (2006.01) |
| ***F25B 21/04*** | (2006.01) |
| ***F25D 23/12*** | (2006.01) |
| *F25B 27/00* | (2006.01) |

(52) U.S. Cl.
CPC ..... *F25D 23/126* (2013.01); *F25B 27/00* (2013.01); *F25B 2321/023* (2013.01); *F25B 2321/0252* (2013.01); *F25B 2500/06* (2013.01); *F25D 2331/803* (2013.01)

(58) Field of Classification Search
CPC .... F25D 31/002; F25D 31/006; F25D 31/007; F25D 2331/803; F25D 2400/10; F25D 2400/40; H05K 2201/10219; F25J 2270/908; F24F 1/0097; F24F 1/00378
See application file for complete search history.

(56) References Cited

U.S. PATENT DOCUMENTS

| | | | | |
|---|---|---|---|---|
| 2010/0115969 | A1* | 5/2010 | Tuszkiewicz ..... | A47F 3/001 62/3.3 |
| 2010/0147003 | A1* | 6/2010 | Ueda ..... | A23B 4/066 62/314 |
| 2017/0056289 | A1* | 3/2017 | Tsuno ..... | A61J 1/165 |

* cited by examiner

THERMOELECTRIC WINE CABINET WITH AN EXTERNAL POWER SUPPLY

TECHNICAL FIELD

The present invention relates to the field of wine cabinets, and in particular to thermoelectric wine cabinets with an external power supply.

BACKGROUND

Thermoelectric wine cabinets are a kind of electric appliance or small biomimetic wine cellar designed by simulating natural storage conditions of wine, and are different from those usual wine cabinets for displaying wine. Generally, the thermoelectric wine cabinets have an internal thermostatic environment. In the prior art, an internal power supply is provided to an AC/DC circuit inside the thermoelectric wine cabinet, and may be easily damaged due to the fact that the wine cabinet subjects to a long-term use under energized condition and to influence of high temperature and a large current. Thus, there is still a possibility that the internal power supply is easily damaged whether a new internal power supply is provided to replace the original one or whether the original one is maintained. Further, when the internal power supply is maintained, the thermoelectric wine cabinet is required to be dismantled. For those who do not know the internal configuration of the thermoelectric wine cabinet, it is complicated to assemble the dismantled wine cabinet, thereby to cause secondary damage to the configuration of the thermoelectric wine cabinet. Even for those professional servicemen, repeated dismantlement of the thermoelectric wine cabinet may also cause varying degrees of damage to devices inside the wine cabinet, and the maintenance is very inconvenient.

SUMMARY

The objective of the present invention is to provide a thermoelectric wine cabinet with an external power supply which can be directly maintained in the event of malfunction without dismantlement of the wine cabinet, thereby avoiding secondary damage to the wine cabinet and making maintenance more convenient.

To achieve the above objective, the present invention provides the following technical scheme:

A thermoelectric wine cabinet with an external power supply comprises a case, a door, a circuit board, a refrigeration system, a power cord, an external power supply and a water-receiving member that opens upwards.

The case comprises a housing, a liner and a heat insulating layer provided between the housing and the liner. A rear end of the case is provided with a chamber that opens rearwards for containing the water-receiving member. A heat dissipation chamber is provided above the chamber for containing the water-receiving member. The refrigeration system is provided inside the heat dissipation chamber. The circuit board is provided on a rear plate of the housing inside the heat dissipation chamber. The power cord passes through a wall of the heat dissipation chamber, extends into the heat dissipation chamber and is connected to the circuit board. The water-receiving member communicates with the liner through a water-receiving groove passing through the heat insulating layer. The external power supply is a DC-output type and provided to the power cord outside the heat dissipation chamber.

Optionally, a partition plate is provided inside the housing, the heat insulating layer is located between the partition plate and the liner, and the heat dissipation chamber and the water-receiving member are located between the partition plate and the rear plate of the housing.

Optionally, an override chamber projecting rearwards and with a front opening and a rear opening is provided in the partition plate, and two side plates of the override chamber are each provided with a first round hole. The partition plate is further provided with an annular frame, two side plates of which are each provided with a second round hole. The first round hole corresponds to the second round hole. The override chamber is connected to the annular frame by screws passing through the first and second round holes.

Optionally, drainage holes are provided inside the liner, and the water-receiving groove is provided in a rear wall of the liner. The drainage holes communicates with the water-receiving groove, and the water-receiving groove communicates with the water-receiving member by a conduit passing through the partition plate.

Optionally, a receiving chamber projecting rearwards and with a front opening and a rear opening is provided in the rear wall of the liner. The rear opening of the receiving chamber is provided with an annular interface, and the front opening of the receiving chamber is provided with counterbores. The receiving chamber is securely connected to the liner by screws passing through the counterbores.

Optionally, an annular receiving groove is provided in a front end face of the annular frame and configured to be engaged with the annular interface, and the receiving chamber is provided in the override chamber and matches the shape thereof.

Optionally, the refrigeration system comprises a refrigeration device and a heat dissipation device. The refrigeration device is fixed by the annular frame and comprises a heat insulating liner, a semiconductor chilling plate and a cold dissipation aluminum member. A mounting hole is provided at a center of the heat insulating liner, and the semiconductor chilling plate is provided at one end of the mounting hole and attached to the rear opening of the override chamber. The cold dissipation aluminum member comprises vertical portions perpendicular to the partition plate and horizontal portions parallel to the partition plate. The vertical portions extend into the mounting hole and is in contact with a cold surface of the semiconductor chilling plate. The horizontal portions are embodied in the receiving chamber and in parallel with the rear opening of the receiving chamber. The heat dissipation device comprises heat dissipation tubes, fins, a heat dissipation aluminum member, an exhaust fan and a mounting plate. The exhaust fan is provided on one surface of the mounting plate, and the fins are provided on another surface of the mounting plate. The heat dissipation tubes pass through the fins and overlie the heat dissipation aluminum member. Distilled water is provided inside the heat dissipation tubes. A hot surface of the semiconductor chilling plate is in contact with the heat dissipation aluminum member of the heat dissipation device.

Optionally, a cold dissipation fan, a fan cover and the circuit board are provided in the receiving chamber. The cold dissipation fan is parallel to the horizontal portions of the cold dissipation aluminum member. The circuit board is provided between the cold dissipation fan and the horizontal portions of the cold dissipation aluminum member. The fan cover is located at the front opening of the receiving chamber and in contact with the rear wall of the liner.

Optionally, the heat insulating layer surrounds the annular frame and is filled in a gap between the receiving chamber and the override chamber.

Optionally, a projecting exhaust hood is provided on an upper portion of the rear plate of the housing and is fixed outside the exhaust fan. Two side plates of the housing to which the heat dissipation chamber is provided are provided with air inlet holes, and a lower portion of the rear plate of the housing is provided with air outlet holes.

Optionally, the number of the heat dissipation tubes is N.

According to specific embodiments provided in the present invention, the present invention has the following beneficial effects: the external power supply provided outside the thermoelectric wine cabinet can be directly maintained or replaced in the event of malfunction without dismantlement of the thermoelectric wine cabinet, thereby avoiding secondary damage to the wine cabinet and making maintenance more convenient.

BRIEF DESCRIPTION OF THE DRAWING

In order to illustrate technical solutions of embodiments of the invention more clearly, a simple description will be made below about drawings referred to in the embodiments. Apparently, these drawings below depict only typical embodiments of the invention. Other relevant drawings can also be obtained by those skilled in the art based on these drawings below without creative efforts.

DETAILED DESCRIPTION

The embodiments of the present invention will be described below in a clear and complete manner in conjunction with the appended drawings. It should be definite that, the described embodiments are only a part of the embodiments of the present invention, without covering all embodiments. All other embodiments obtained by those skilled in the art based on the embodiments of the present invention without creative efforts shall fall within the protection scope of the present invention.

The objective of the present invention is to provide a thermoelectric wine cabinet with an external power supply, the external power supply of which can be directly maintained or replaced when it is damaged and thus is more convenient to be maintained.

In order to make the above objective, features and advantages of the present invention more clear and obvious, the present invention will be described in detail with reference to the appended drawings and embodiments hereinafter.

Figure 1:
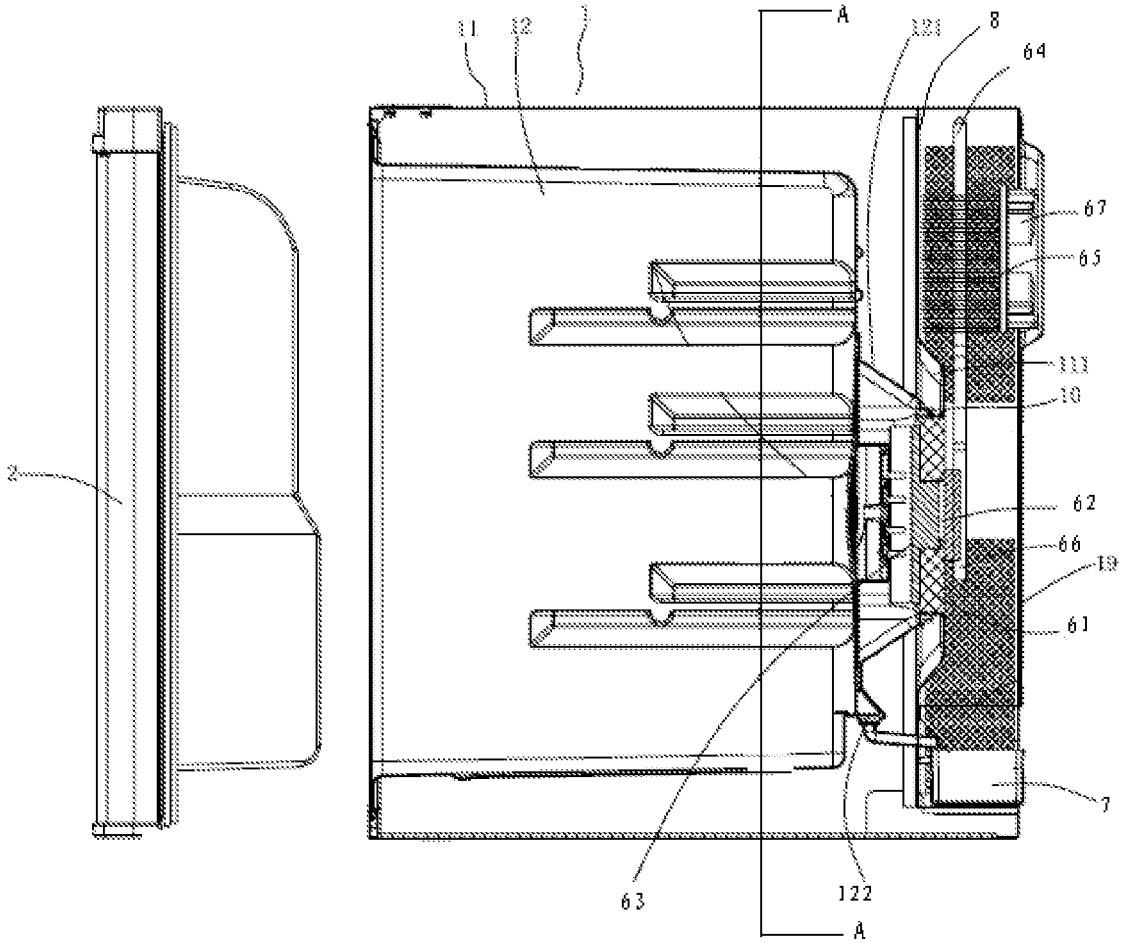
FIG. 1 is a sectional view of a thermoelectric wine cabinet according to the invention.
Figure 2:
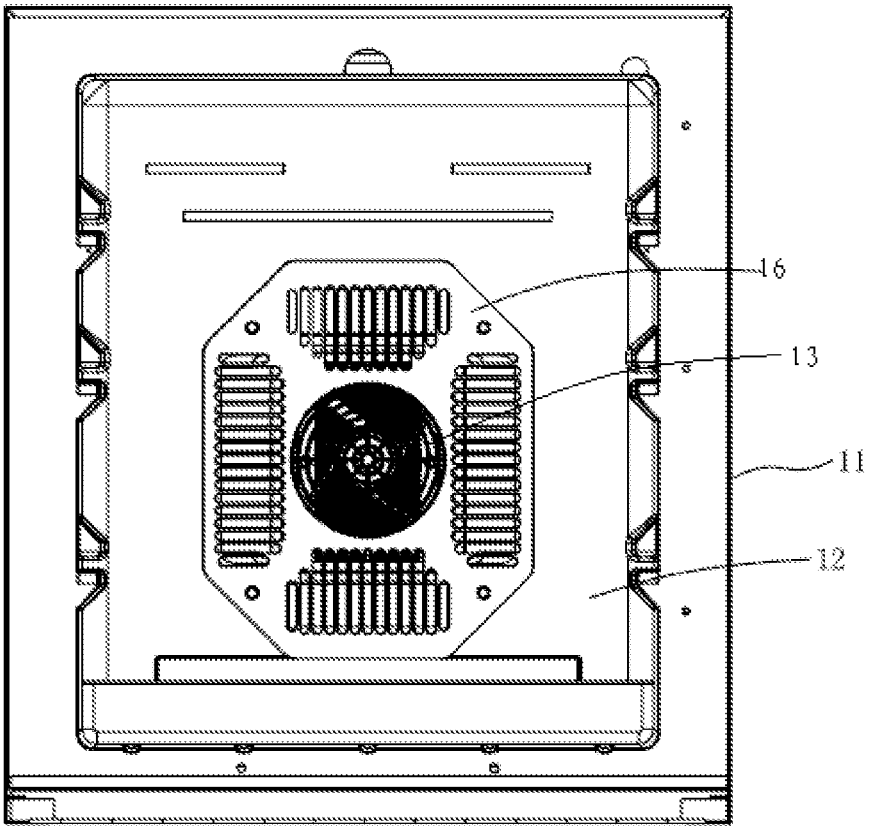
FIG. 2 is a sectional view taken along the line A-A in FIG. 1.
Figure 3:
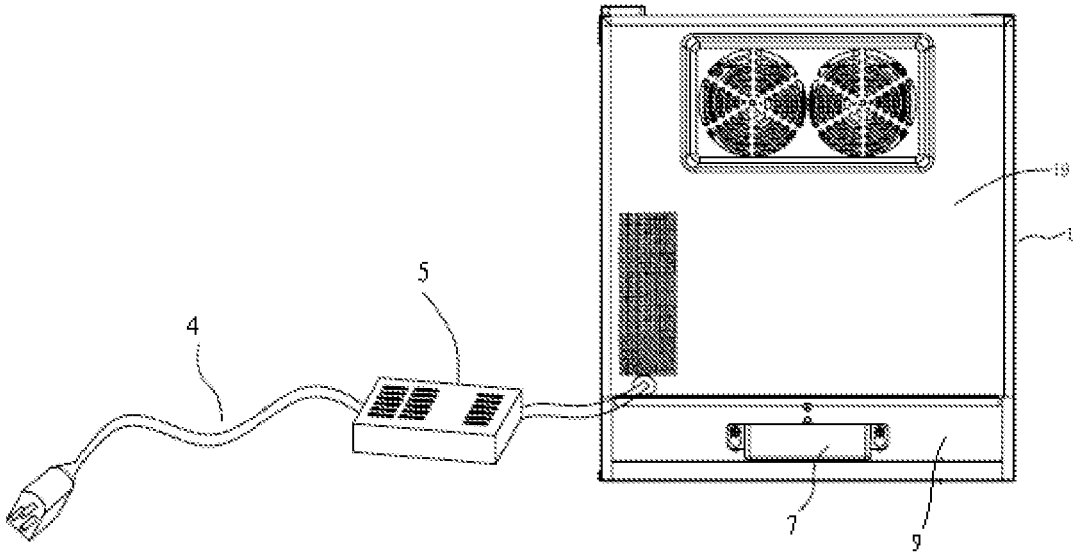
FIG. 3 is a rear view of the thermoelectric wine cabinet according to the invention.

FIG. 1 is a sectional view of a thermoelectric wine cabinet according to the invention, FIG. 2 is a sectional view taken along the line A-A in FIG. 1, and FIG. 3 is a rear view of the thermoelectric wine cabinet. As shown in FIGS. 1 through 3, the thermoelectric wine cabinet of the invention includes a case 1, a door 2, a circuit board 3, a power cord 4, an external power supply 5, a refrigeration system 6 and a water-receiving member 7 with an upper opening.

The case 1 includes a housing 11, a liner 12 and a heat insulating layer arranged between the housing 11 and the liner 12. A rear end of the case 1 is provided with a chamber 9 that opens rearwards for containing the water-receiving member. A heat dissipation chamber is provided above the chamber 9, and the refrigeration system 6 is provided inside the heat dissipation chamber. The circuit board 3 is provided on a rear plate of the housing 11 inside the heat dissipation chamber. The power cord 4 passes through a wall of the heat dissipation chamber, extends into the heat dissipation chamber and is connected to the circuit board 3. The water-receiving member 7 communicates with the liner 12 through a water-receiving groove 122 which passes through the heat insulating layer. The external power supply 5 is a DC-output type, and is provided to the power cord 4 outside the heat dissipation chamber.

By using the thermoelectric wine cabinet of the invention, the external power supply thereof can be directly maintained or replaced in the event of malfunction without dismantlement of the thermoelectric wine cabinet. Thus, no damage is caused to the inner structure of the thermoelectric wine cabinet.

Figure 4:
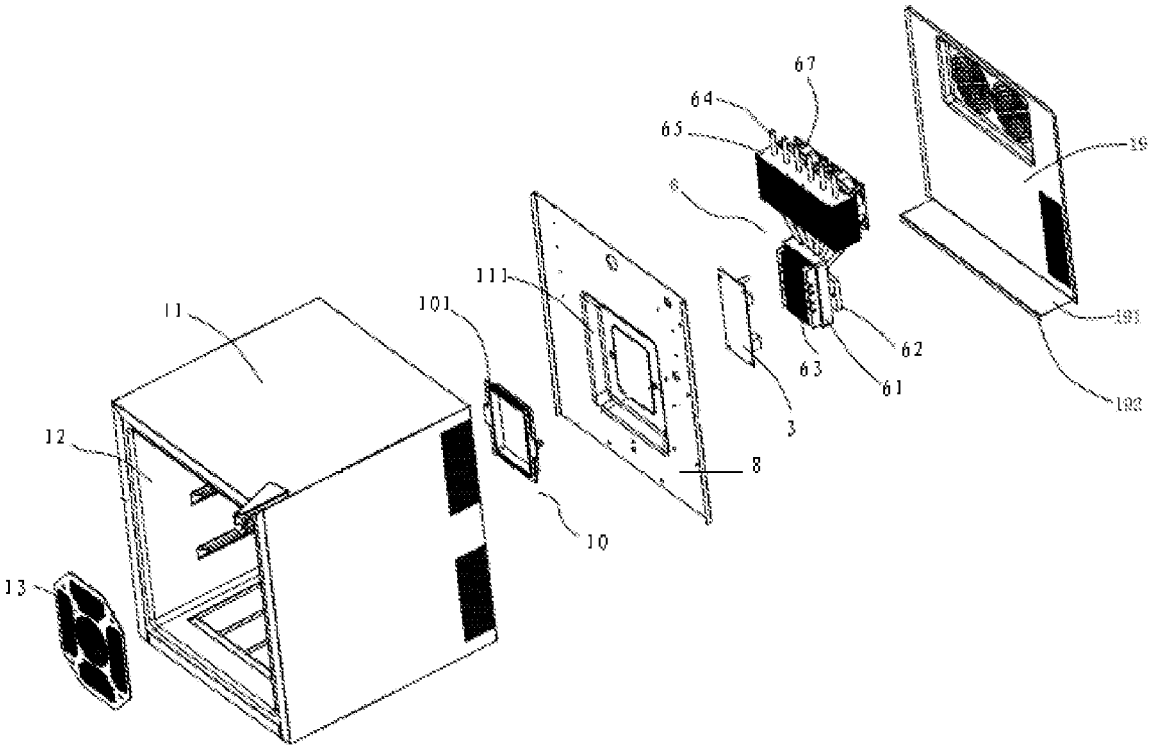
FIG. 4 is an exploded, front perspective view of the thermoelectric wine cabinet according to the invention.
Figure 5:
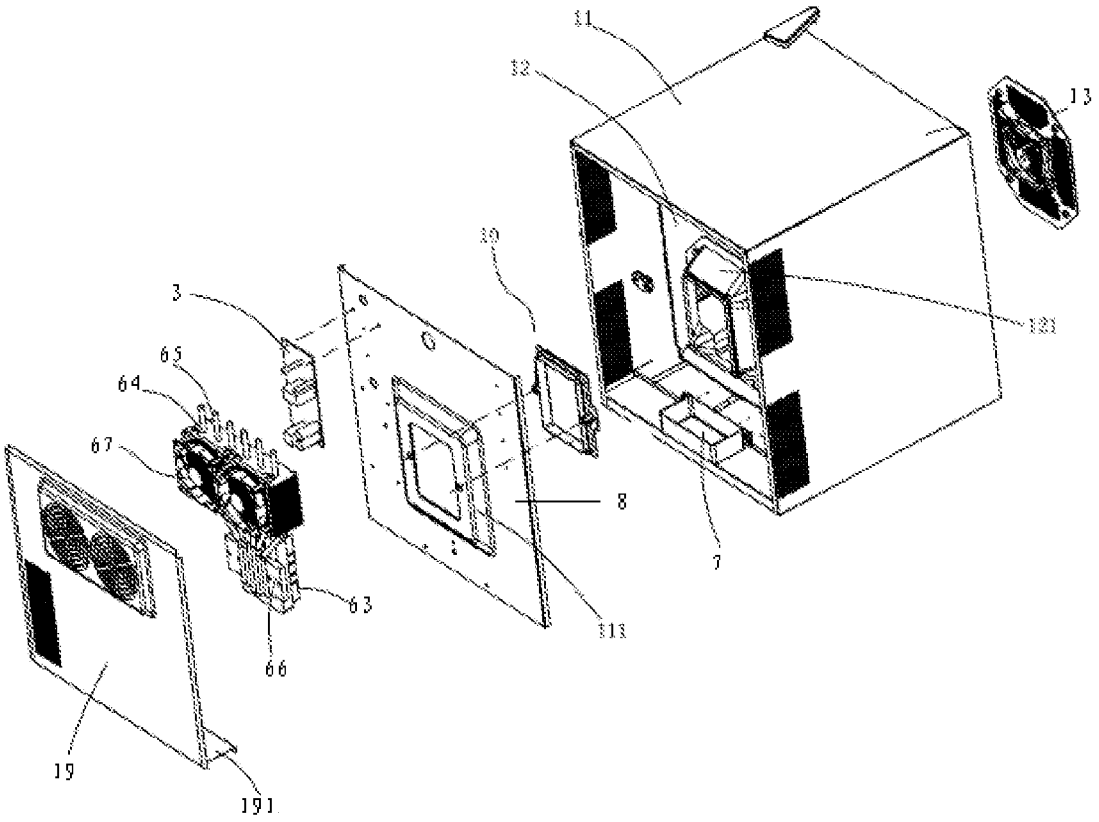
FIG. 5 is an exploded, rear perspective view of the thermoelectric wine cabinet according to the invention.

FIG. 4 is an exploded, front perspective view of the thermoelectric wine cabinet according to the invention, and FIG. 5 is an exploded, rear perspective view of the thermoelectric wine cabinet according to the invention. As shown in FIGS. 4 and 5, in practical application, a partition plate 8 is provided inside the housing 11. The heat insulating layer is located between the partition plate 8 and the liner 12. The heat dissipation chamber and the water-receiving member 7 with the upper opening are located between the partition plate 8 and a rear plate 19 of the housing 11. An override chamber 111 projecting rearwards and with a front opening and a rear opening is provided in the partition plate 8. Two side plates of the override chamber 111 are each provided with a first round hole. The partition plate 8 is further provided with an annular frame 10, two side plates of which are each provided with a second round hole. The first round hole corresponds to the second round hole. The override chamber 111 is connected to the annular frame 10 by screws passing through the first and second round holes.

In practical application, specifically, drainage holes are provided inside the liner 12, and the water-receiving groove is provided in a rear wall of the liner 12. The drainage holes communicate with the water-receiving groove 122, and the latter communicates with the water-receiving member 7 by a conduit passing through the partition plate 8.

When there is water present in the thermoelectric wine cabinet, the excess water can be removed from the thermoelectric wine cabinet through the drainage holes provided in the liner, thereby to provide a dry and appropriate environment for the thermoelectric wine cabinet.

In practical application, a receiving chamber 121 projecting rearwards and with a front opening and a rear opening is provided in the rear wall of the liner 12. The rear opening of the receiving chamber is provided with an annular interface, and the front opening thereof is provided with counterbores. The receiving chamber is securely connected to the liner 12 by screws passing through the counterbores.

In practical application, specifically, an annular receiving groove 101 is provided in a front end face of the annular frame 10. The annular receiving groove 101 is configured to be engaged with the annular interface. The receiving chamber is provided in the override chamber 111 and matches the shape thereof.

In practical application, the refrigeration system specifically includes a refrigeration device and a heat dissipation device. The refrigeration device is fixed by the annular frame 10. The refrigeration device includes an heat insulating liner 61, a semiconductor chilling plate 62, and a cold dissipation aluminum member 63. A mounting hole is provided at a center of the heat insulating liner 61, and the semiconductor chilling plate 62 is provided at one end of the mounting hole and attached to the rear opening of the override chamber 111. The cold dissipation aluminum member 63 includes vertical portions perpendicular to the partition plate 8, and horizontal portions parallel to the partition plate 8. The vertical portions are configured to extend into the mounting hole and be in contact with a cold surface of the semiconductor chilling plate 62. The horizontal portions are configured to be embodied in the receiving chamber 121 and parallel to the rear opening of the receiving chamber. A hot surface of the semiconductor chilling plate 62 is configured to be in contact with a heat dissipation aluminum member of the heat dissipation device.

The heat dissipation device includes heat dissipation tubes 64, fins 65, the heat dissipation aluminum member 66, an exhaust fan 67 and a mounting plate. The exhaust fan 67 is provided on one surface of the mounting plate, and the fins 65 are provided on another surface thereof. The heat dissipation tubes 64 are configured to pass through the fins 65 and overlie the heat dissipation aluminum member 66. Distilled water is provided in the heat dissipation tubes 64 with the number of N.

The above refrigeration system can provide a suitable temperature for the thermoelectric wine cabinet. The refrigeration device and the heat dissipation device cooperate to remove heat from the thermoelectric wine cabinet through the heat dissipation device. The distilled water in the heat dissipation tubes 64 is circulated such that the heat is removed from the dissipation device through the dissipation tubes 64. By applying a direct current to the semiconductor chilling plate, heat generated during an electrical function can be adsorbed and a refrigeration process thus can be performed. A layer of frost can be formed within a few minutes or less. In another embodiment, two different semiconductor chilling plates may be used. When two different conductors A and B are used to form a circuit and a direct current is applied thereto, besides Joule heat, some other form of heat is also released at one joint, and the heat is adsorbed at another joint. This phenomena caused by Peltier effect is reversible. When reversing the current, the joints releasing and adsorbing heat are also reversed accordingly. The heat released or adsorbed is directly proportional to an electrical current intensity I and is related to properties of the two conductors and the temperature of a hot end. By utilizing this kind of heat releasing and adsorbing manner, an appropriate storage environment thus can be provided for the thermoelectric wine cabinet.

In practical application, a cold dissipation fan 13, a fan cover 16 and the circuit board 3 are provided in the receiving chamber. The cold dissipation fan 13 is mounted in the receiving chamber and parallel to the horizontal portions of the cold dissipation aluminum member. The circuit board 3 is provided between the cold dissipation fan 13 and the horizontal portions of the cold dissipation aluminum member. The fan cover 16 is located at the front opening of the receiving chamber and in contact with the rear wall of the liner 12.

In practical application, the heat insulating layer surrounds the annular frame 10 and is filled in a gap between the receiving chamber and the override chamber 111.

In practical application, a projecting exhaust hood is provided on an upper portion of the rear plate of the housing 11. The exhaust hood is fixed outside the exhaust fan 67. Two side plates of the housing 11 to which the heat dissipation chamber is provided are provided with air inlet holes. A lower portion of the rear plate of the housing 11 is provided with air outlet holes.

According to the invention, a plurality of air inlet holes and air outlet holes are provided. In this way, an internal circulation can be achieved for the working area (i.e., the area in which the refrigeration system works) of the circuit of the thermoelectric wine cabinet, and ventilation therein can thus be achieved in time, avoiding the problem of damage of the refrigeration system due to an excessively high internal temperature.

Figure 6:
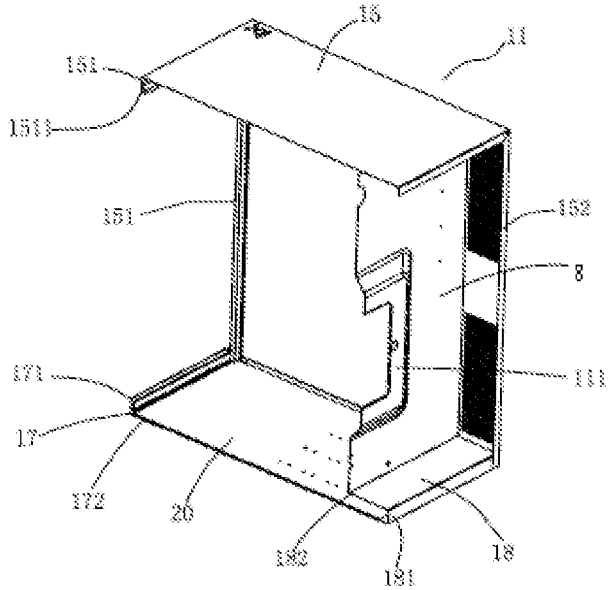
FIG. 6 shows a partial section of a case of the thermoelectric wine cabinet according to the invention.

FIG. 6 shows a partial section of the case of the thermoelectric wine cabinet according to the invention. As shown in FIG. 6, the housing 11 includes a case housing 15 with a front opening, a rear opening and a lower opening, a front support 17, a rear support 18, the rear plate 19 and a bottom plate 20. A top plate and side plates of the case housing 15 at the front opening are each provided with a front plate 151, the top plate and the side plates of the case housing 15 at the rear opening are each provided with a blocking plate 152, and the two side plates of the case housing 15 at the lower opening are each provided with a foot plate 153. Each front plate defines a locking slot 1511. The front support 17 includes a base plate 172, and a vertical plate 171 with a locking slot. The rear support 18 includes a right-angled base plate member 181 and a right-angled upper plate member 182, and a horizontal plate of the upper plate member 182 is connected to a vertical plate of the base plate member 181. Said air outlet holes are provided in the upper portion of the rear plate 19, and a lower end of the rear plate 19 is provided with a horizontal plate 191 perpendicular thereto and a connection plate 192 perpendicular to the horizontal plate 191.

Two ends of the vertical plate 171 of the front support 17 are connected to lower ends of the front plates 151 on both sides of the front opening of the case housing 15. The foot plates 153 of the case housing 15 are located on and fixed to the base plate 172 of the front support 17. The base plate member 181 is provided at a rear end of the case housing 15, and two ends of a horizontal plate thereof are located on and fixed to the foot plates 153. A lower end of the partition plate 8 is located on the horizontal plate of the upper plate member 182 and in contact with a vertical plate of the upper plate member 182. The bottom plate 20 is located on the foot plates 153 of the case housing 15. A front end of the bottom plate 20 is engaged with the vertical plate 171 of the front support 17, and its rear end is connected to the horizontal plate of the base plate member 181.

Figure 7:
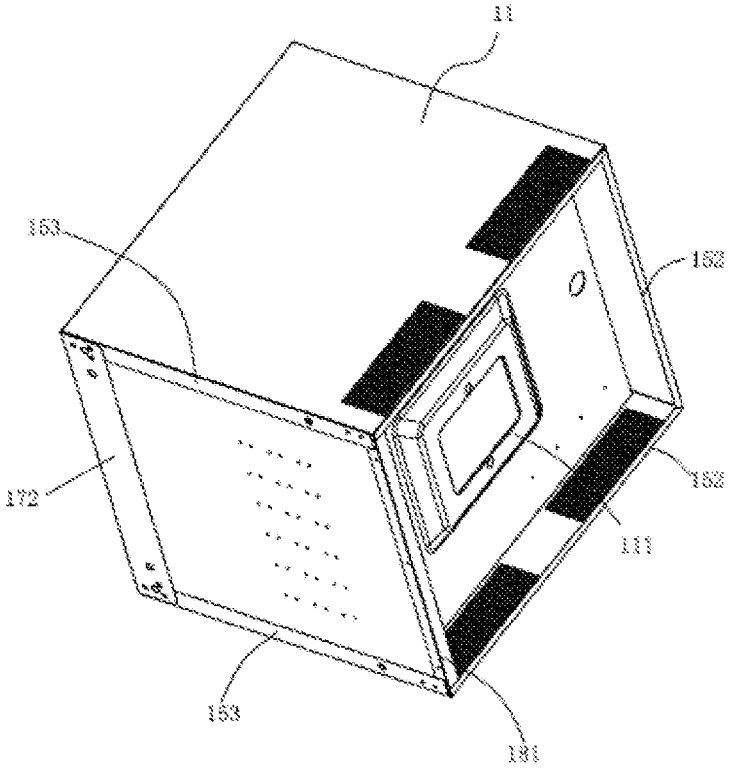
FIG. 7 is a perspective view of the case of the thermoelectric wine cabinet according to the invention.

For convenience of understanding, FIG. 7 provides a perspective view of the case of the thermoelectric wine cabinet according to the invention. As shown in this Figure, the horizontal plate 191 and the connection plate 192 of the rear plate 19 extend into the case housing 15, and two ends of each are in contact with the side plates of the case housing 15. The connection plate 192 is in contact with and connected to the partition plate 8. The rear plate 19 covers the rear opening of the case housing 15 to form said heat dissipation chamber.

A front opening of the liner 12 is provided with an annular plate which is configured to be inserted into the lock slots, i.e., the locking slots 1511 of the front plates 151 and the locking slot of the vertical plate 171 of the front support 17.

Each embodiment of the invention is described in a progressive manner and focusing on the differences from the others, and reference can be made to the description of the other embodiments for the same or similar parts.

Specific examples are used herein to illustrate the principle and embodiments of the present invention, and the above description of the embodiments is only used to help understanding the methods and core concept of the present invention. It is apparent to those skilled in the art that the embodiments and application range of the invention may be varied based on the basic idea of the invention. Therefore, this description is not intended to limit the invention.

REFERENCE LIST

1 Case
2 Door
3 Circuit board
4 Power cord
5 External power supply
6 Refrigeration system
7 Water-receiving member
8 Partition plate
9 Chamber for containing the water-receiving member
10 Annular frame
101 Annular receiving groove
11 Housing
111 Override chamber
12 Liner
121 Receiving chamber
122 Water-receiving groove
13 Cold dissipation fan
61 Heat insulating liner
62 Semiconductor chilling plate
63 Cold dissipation aluminum member
64 Heat dissipation tube
65 Fins
66 Heat dissipation aluminum member
67 Exhaust fan
15 Case housing
16 Fan cover
17 Front support
18 Rear support
19 Rear plate
20 Bottom plate
151 Front plate
152 Blocking plate
153 Foot plate
1511 Locking slot
171 Vertical plate
172 Base plate
181 Right-angled base plate member
182 Right-angled upper plate member
191 Horizontal plate perpendicular to the rear plate 19
192 Connection plate perpendicular to the horizontal plate 191

What is claimed is:

1. A thermoelectric wine cabinet with a power supply external to the thermoelectric wine cabinet, comprising:

a water-receiving member, which is a box having an upper opening;

a case, comprising a housing, a liner and a heat insulating layer provided between the housing and the liner, and a rear end of which is provided with a chamber that opens rearwards for containing the water-receiving member; wherein, a heat dissipation chamber is provided above the chamber for containing the water-receiving member, and the upper opening of the water-receiving member communicates with the liner through a water-receiving groove passing through the heat insulating layer;

a refrigeration system provided inside the heat dissipation chamber;

a circuit board provided on a rear plate of the housing inside the heat dissipation chamber;

a power cord passing through a wall of the heat dissipation chamber, extending into the heat dissipation chamber and being connected to the circuit board;

the power supply, which is a DC-output type, is connected to the power cord, and is provided outside the heat dissipation chamber;

a partition plate provided inside the housing, the heat-dissipation chamber and the water-receiving chamber being located between the partition plate and the rear plate of the housing;

an override chamber, including a front opening and a rear opening, provided in the partition plate, the override chamber projecting rearwards from the partition plate and toward the rear plate, wherein the rear opening of the override chamber is open to the rear plate of the housing to accommodate part of the refrigeration system, and the front opening of the override chamber is opposite to the rear opening and open to the liner, and wherein the water-receiving groove communicates with the water-receiving member by passing through the partition plate; and a door.

2. The thermoelectric wine cabinet of claim 1, wherein the heat insulating layer is located between the partition plate and the liner, and wherein two side plates of the override chamber are each provided with a first round hole, the partition plate is further provided with an annular frame, two side plates of the annular frame being each provided with a second round hole, each of the two second round holes being corresponding to a respective one of the two first round holes, and the override chamber is connected to the annular frame by screws passing through the first and second round holes.

3. The thermoelectric wine cabinet of claim 2, wherein drainage holes are provided inside the liner, the water-receiving groove is provided in a rear wall of the liner, and the drainage holes communicates with the water-receiving groove.

4. The thermoelectric wine cabinet of claim 2, wherein a receiving chamber projecting rearwards and with a front opening and a rear opening is provided in a rear wall of the liner;

wherein, the rear opening of the receiving chamber is provided with an annular interface, the front opening of the receiving chamber is provided with counterbores, and the receiving chamber is securely connected to the liner by screws passing through the counterbores.

5. The thermoelectric wine cabinet of claim 2, wherein an annular receiving groove is provided in a front end face of the annular frame;

wherein, the annular receiving groove is configured to be engaged with the annular interface, and the receiving chamber is provided in the override chamber and matches the shape thereof.

6. The thermoelectric wine cabinet of claim 4, wherein the refrigeration system comprises:

a refrigeration device, fixed by the annular frame and comprising:

a heat insulating liner, at a center of which is provided a mounting hole;

a semiconductor chilling plate, provided at one end of the mounting hole and attached to the rear opening of the override chamber; and a cold dissipation aluminum member comprising:

vertical portions perpendicular to the partition plate and extending into the mounting hole to be in contact with a cold surface of the semiconductor chilling plate; and horizontal portions parallel to the partition plate and embodied in the receiving chamber in parallel with the rear opening of the receiving chamber; and a heat dissipation device comprising:

a mounting plate;

an exhaust fan provided on one surface of the mounting plate;

fins provided on another surface of the mounting plate;

a heat dissipation aluminum member; and heat dissipation tubes passing through the fins and overlying the heat dissipation aluminum member, and inside of which is provided distilled water;

wherein, a hot surface of the semiconductor chilling plate is in contact with the heat dissipation aluminum member of the heat dissipation device.

7. The thermoelectric wine cabinet of claim 6, wherein a cold dissipation fan, a fan cover and the circuit board are provided in the receiving chamber;

wherein, the cold dissipation fan is parallel to the horizontal portions of the cold dissipation aluminum member, the circuit board is provided between the cold dissipation fan and the horizontal portions of the cold dissipation aluminum member, and the fan cover is located at the front opening of the receiving chamber and in contact with the rear wall of the liner.

8. The thermoelectric wine cabinet of claim 6, wherein the heat insulating layer surrounds the annular frame and is filled in a gap between the receiving chamber and the override chamber.

9. The thermoelectric wine cabinet of claim 6, wherein a projecting exhaust hood is provided on an upper portion of the rear plate of the housing and is fixed outside the exhaust fan, two side plates of the housing to which the heat dissipation chamber is provided are provided with air inlet holes, and a lower portion of the rear plate of the housing is provided with air outlet holes.

10. The thermoelectric wine cabinet of claim 6, wherein the number of the heat dissipation tubes is N.

* * * * *